US006997200B2

(12) United States Patent
King

(10) Patent No.: US 6,997,200 B2
(45) Date of Patent: Feb. 14, 2006

(54) WATER CONSERVATION SYSTEM

(76) Inventor: Nelson J. King, P.O. Box 226, East Boothbay, ME (US) 04544

( * ) Notice: Subject to any disclaimer, the term of this patent is extended or adjusted under 35 U.S.C. 154(b) by 344 days.

(21) Appl. No.: 10/367,529

(22) Filed: Feb. 19, 2003

(65) Prior Publication Data

US 2004/0159353 A1 Aug. 19, 2004

(51) Int. Cl.
*F16K 49/00* (2006.01)

(52) U.S. Cl. ..... 137/1; 137/337; 137/362; 137/559; 137/563; 137/625.41; 4/363

(58) Field of Classification Search ..... 137/337, 137/625.41, 563, 1, 2, 559; 126/362
See application file for complete search history.

(56) References Cited

U.S. PATENT DOCUMENTS

| | | | | |
|---|---|---|---|---|
| 372,232 | A | 10/1887 | Newman | |
| 3,645,493 | A | 2/1972 | Manoogian et al. | 251/120 |
| 4,028,118 | A * | 6/1977 | Nakasuji et al. | 106/31.19 |
| 4,201,518 | A * | 5/1980 | Stevenson | 417/12 |
| 4,577,653 | A | 3/1986 | Marty | 137/119 |
| 4,606,325 | A * | 8/1986 | Lujan, Jr. | 122/13.3 |
| 4,870,986 | A * | 10/1989 | Barrett et al. | 137/119.1 |
| 4,945,942 | A * | 8/1990 | Lund | 137/337 |
| 5,331,996 | A | 7/1994 | Ziehra | 137/14 |
| 5,351,712 | A * | 10/1994 | Houlihan | 137/337 |
| 5,493,739 | A | 2/1996 | Bezdck | 4/638 |
| 5,511,579 | A | 4/1996 | Price | 137/337 |
| 5,524,666 | A | 6/1996 | Linn | 137/337 |
| 5,606,987 | A | 3/1997 | Weber | 137/1 |
| 5,689,843 | A | 11/1997 | Duke et al. | 4/675 |
| 5,735,291 | A | 4/1998 | Kaonohi | 137/337 |
| 5,829,467 | A * | 11/1998 | Spicher | 137/14 |
| 6,032,687 | A | 3/2000 | Linn | 137/337 |
| 6,161,567 | A | 12/2000 | Ziehm | 137/357 |
| 6,382,125 | B1 | 5/2002 | Tamura | 116/207 |
| 6,425,148 | B1 | 7/2002 | Chen | 4/665 |

* cited by examiner

*Primary Examiner*—A. Michael Chambers
(74) *Attorney, Agent, or Firm*—Russell J. Egan

(57) ABSTRACT

The invention recirculates and/or recycles fluids normally lost down the drain during the time it takes for a desired temperature to be attained for usage of the hot fluids. A recirculating/recycling valve, through which hot fluids may flow, has an additional port fitted to the valve body, which by positioning the handle in a singularly unique position, fluids not at the desired temperature are sent back to the source from which they came, to a recycling toilet tank system or to a recycling standpipe at atmospheric pressure.

12 Claims, 8 Drawing Sheets

WATER CONSERVATION SYSTEM

BACKGROUND OF THE INVENTION

1. The Field of the Invention

The present invention is a system for conserving water for recycling by recirculating below temperature water standing in hot water pipes and informing the user when the flowing water is at temperature. In particular, the present invention concerns a valve having a position for recirculating water from the hot water line until such time as that water reaches the desired temperature. The subject system also includes temperature indicating means on the valve and a toilet tank modified to accept and utilize recycled water.

2. The Prior Art

A great many gallons of water are wasted daily by turning on hot water taps and showers and waiting until the cold water standing in the hot water pipes passes through the tap. Heretofore this water has simply been allowed to run down the drain thus not only wasting good water but overburdening waste water treatment plant with additional volumes of water.

One approach to solving this problem is represented by U.S. Pat. No. 5,331,996 to Ziehra, which uses a heat exchanger between the source of hot water and the hot water taps. The object of this invention is to supply hot water directly to the taps. This invention would not be energy efficient because of the energy consumption in heating water at multiple locations.

A unique approach is provided by Weber in U.S. Pat. No. 5,606,987 by substituting cold water for hot water in taps that will always drip. Thus, while the hot water is not wasted, there remains the waste of cold water.

U.S. Pat. No. 5,735,291 to Kaonohi addresses the problem by utilizing extra pumps and plumbing making the entire installation a very costly initially and in which the savings would hardly justify both the monetary expense and energy requirements for operating the multiple pumps.

Another approach is described in U.S. Pat. No. 5,493,739 to Bezdck which describes a thermostatic device controlling the flow of the cool water in a hot water line to the holding tank of a flush toilet until the water in the hot water line reaches a sensed temperature at which point the control switches flow of hot water back to the hot water faucet. This approach creates an energy drain as cold water enters the hot water heater to replenish the water sent to the holding tank or toilet.

Still another approach has been proposed by Linn in U.S. Pat. Nos. 5,524,666 and 6,032,687. Both of these patents recognize the fact that typically water sitting in hot water lines is sent down the drain while heated water fills the hot water pipe. Both of the systems described by Linn utilize thermostatically controlled diverters to control the flow of water in hot water lines. Under temperature water is sent to flush toilet holding tanks while on temperature water is sent to the faucet, shower head, etc. There is also an energy drain caused by the introduction of replenishing cold water into the hot water tank.

A further approach had been to simply place small water heaters in each hot water line in close proximity to each hot water tap. While this will assure hot water substantially instantaneously when the hot water tap is opened, it requires a large capital expense for the extra heaters as well as the expense of operating each of these heaters.

Therefor it is an object of the present invention to overcome the difficulties and deficiencies of the prior art to provide a water conservation system in which cool/cold water standing in hot water lines is recirculated to a storage vessel for later use in a cold water line.

SUMMARY OF THE INVENTION

The invention for consideration is a recirculating/recycling system The system consists of a source of fluid, namely water, liquid(s) or gas(es), a pump pressurizing the system, a hot fluid tank or heating source for the fluid in the system, a recirculating valve fitted with a thermochromic color changing leuco dye temperature sensing system, a return line to the source, a toilet tank system, or to a standpipe at atmospheric pressure or to other known holding tanks.

BRIEF DESCRIPTION OF THE DRAWINGS

The present invention will now be described, by way of example, with reference to the accompanying drawings, in which:

FIG. 4 is a detailed side elevation of the temperature indication means of the present invention;

DETAILED DESCRIPTION OF THE INVENTION

The concept of the invention is to recirculate and recycle fluids, such as conventional tap water normally lost down the drain during the time it takes for a desired temperature to be attained for usage of the water at the hot water tap. For the sake of convenience, while other fluids or gases may be used with the subject invention, the following discussion will refer only to water. And, while the present discussion will mainly concern a domestic application of the invention, it likewise could be used in conjunction with wells and/or cisterns and is particularly suitable for marine situations where fresh water may be at a premium This invention allows recovery of an otherwise lost resource. This is achieved by installing recirculating/recycling valve through which water flows. A valve according to the present invention has an additional port formed through the valve body which, by positioning the handle in a singularly unique position, allows flow of residual cold water in a hot water fine to be sent back to the source from which it came, to a recycling toilet tank system or to a recycling standpipe at atmospheric pressure when flow of hot water from a hot water source is started. This allows reuse of this otherwise wasted water while relieving water treatment facilities by reducing water flow. The diverted water can be used to create pressure sufficient enough to reintroduce water into the pressurized plumbing system in the lower floors of a high rise building. The diverted water can be used as the flush water for a toilet system without increasing the overall water usage, but rather decreasing the waste water flow, and to provide many other advantages, for example, replenish wells, cisterns, and water tanks on boats.

Figure 1:
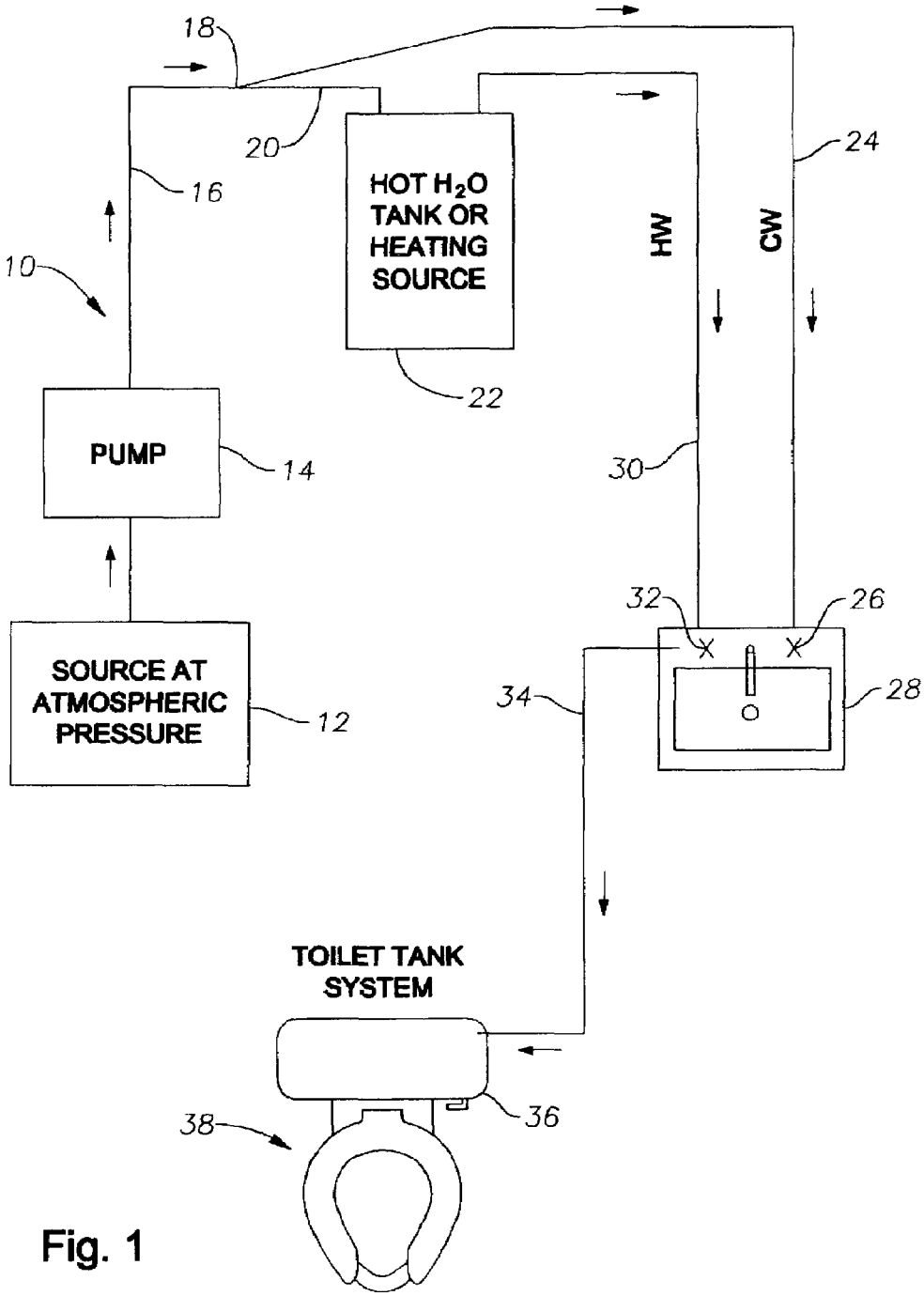
FIG. 1 is a schematic diagram of a representative embodiment of the subject system for domestic applications and which could likewise be used in marine environments.

Turning now to FIG. 1, a typical domestic water system 10 is shown with a water source 12 and a pump 14 connecting the source to a water feed line 16. The feed line 16 has a T junction 18 with one branch line 20 feeding water heater 22 and the other feed line 24 feeding cold water tap 26 at sink 28. A hot water line 30 from the water heater 22 is connected to the hot water tap 32 with a recirculating/recycling line 34 connected between the hot water tap 32 and a tank 36 of a toilet system 38.

Figure 2:
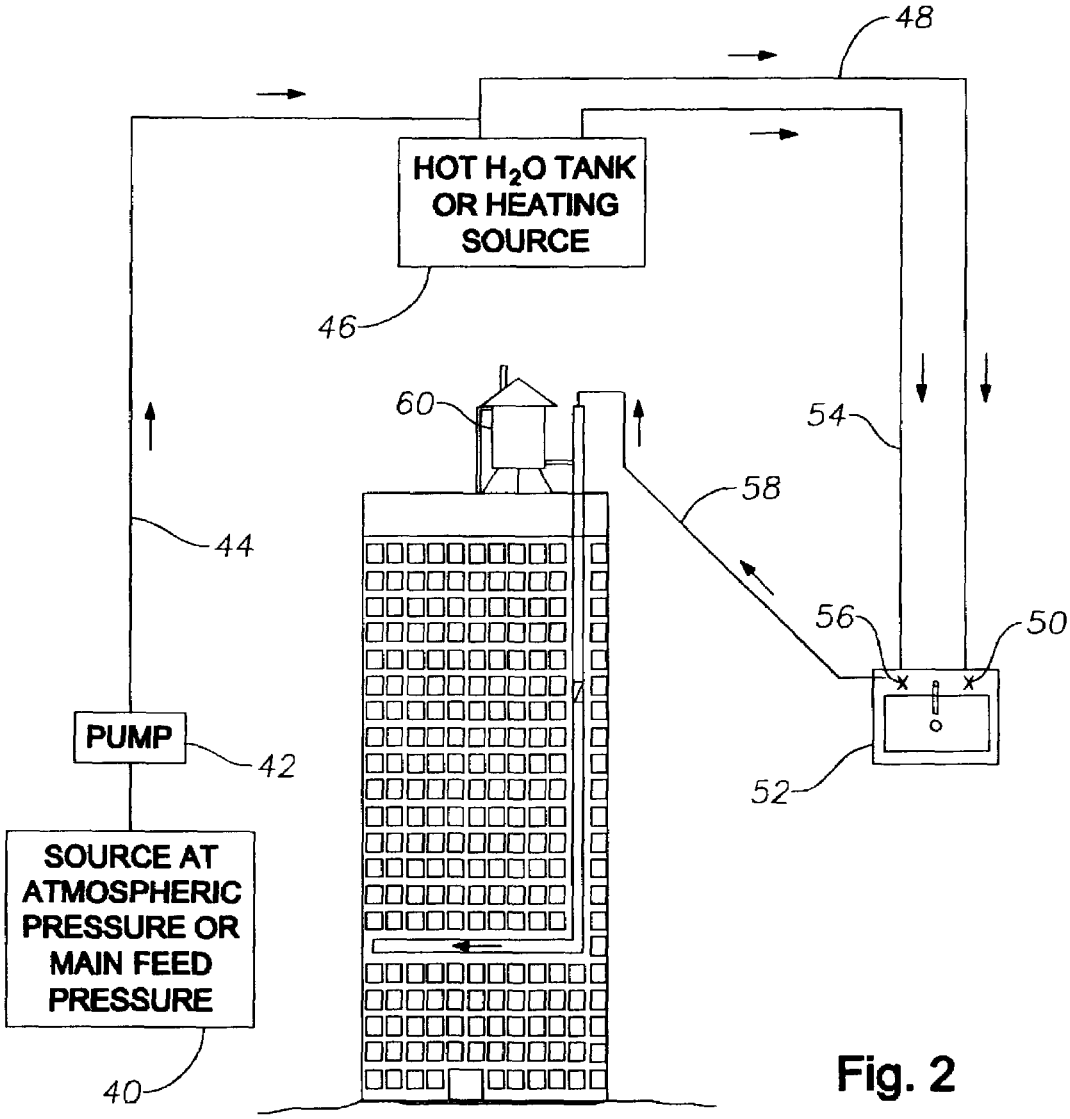
FIG. 2 is a schematic diagram of the subject system in a high rise environment.

FIG. 2 shows a schematic diagram of a high rise system incorporating the subject invention. The water source 40 is connected through a pump 42 to a water feed line 44 which feeds both a water heater 46 and a cold water line 48 leading to a cold water tap 50 at sink 52. A hot water line 54 is connected from the water heater 46 to a hot water tap 56 at a sink 52 A recirculating/recycling line 58 is connected between the hot water tap 56 and water storage tank 60 to a standpipe which creates a head pressure sufficient enough to reintroduce recycled water into the pressurized plumbing system of a high rise building's lower floors.

The present invention has two aspects, each inseparable from the other. The first aspect is to divert the residual cold water in a hot water line from exiting a water faucet where it would be discarded solely because it is not at the desired temperature. The second aspect is to utilize this diverted water in a beneficial manner. The first aspect of the present invention will be discussed with respect to two valve embodiments shown in FIGS. 4 to 9. The second aspect of the subject invention will be described with reference to two toilet systems, the first being a modification to a standard system and the second a new system.

Figure 3:
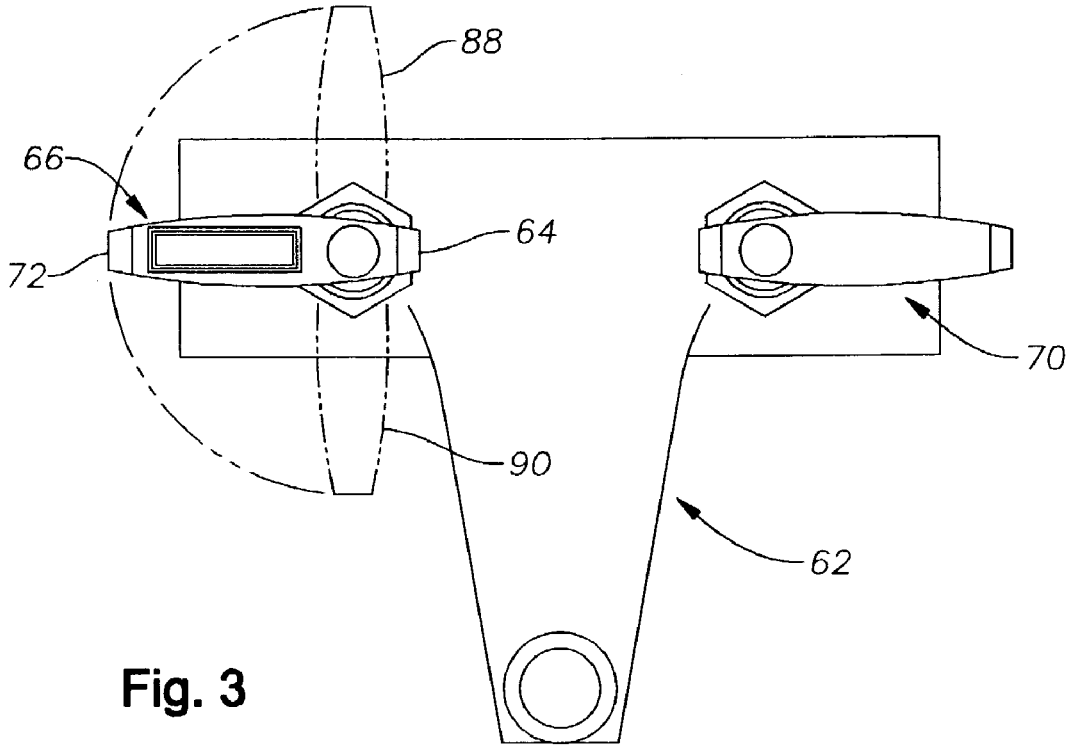
FIG. 3 is a plan view of a faucet embodying the subject invention.
Figure 4A:
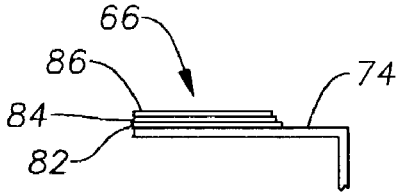
FIG. 4 is a front elevation of the faucet of FIG. 3.
Figure 4:
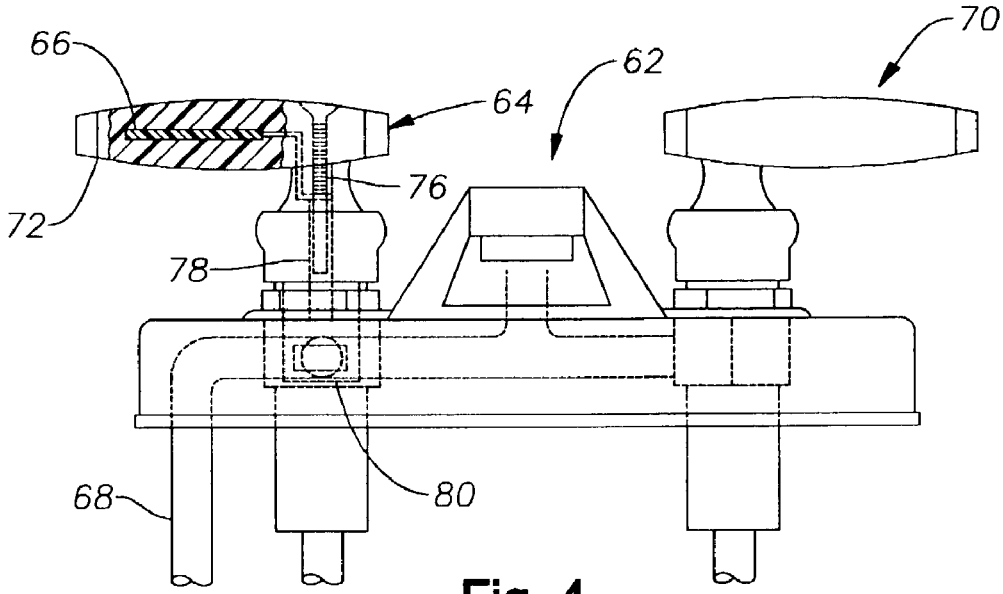

Turning now to FIGS. 3 and 4, a two handle or first embodiment of the subject recirculating/recycling water system 62 is similar to known two handle water faucet systems, except that the hot water tap 64 of the present invention is provided with a water temperature indicator means 66, a flow return line 68 and the capability of moving to a return flow position. The cold water tap 70 of this embodiment is conventional and will not be discussed in detail.

The water temperature indicating means 66 is shown in plan view on the hot water tap handle in FIG. 3, and in side elevation in FIG. 4. It is shown in detailed side elevation in FIG. 4A and is preferably a multilayered assembly of heat sensitive materials whose color and/or transparency changes with temperature.

The hot water tap 64 is fitted with a control handle 72 having affixed thereto the temperature indicating means 66 has a metallic strip 74 which senses the temperature of the water passing through the hot water tap 64. The metallic strip 74 is attached by mechanical means, such as screw 76 to the metal valve stem 78 of the recirculating/recycling valve 80. The metallic strip 74 is coated with a non-changing colored paint 82, a thermochromic leuco dyes 84 and 86 bonded to each other and to the metal strip 74 and, as here shown, mounted within clear plastic handle 72. The coated metal strip 74 would be embedded in the handle material, since the Leuco dye can be sensitive to outside temperatures. The thermochromic leuco dye 86 must be the darkest color, for example, black, darker than the non-changing color paint 82 which preferably is a bright noticeable color, for example red which is the color normally associated with both heat and danger. The thermochromic leuco dye 86 may be formulated chemically to change from opaque black to translucent and then clear at a given temperature range. Thus, when using one dye schedule, if the top dye 86 is formulated to become translucent at 100° F. and becomes transparent at 104° F., then the underlying non-changing color paint 82 will start to appear at 100° F., as the black dye turns translucent, and will be fully visible as red when the dye 86 becomes completely clear at 104° F. When the handle 72 of the recirculating/recycling valve 80 is turned clockwise to the recirculating position (noted in phantom 88 in FIG. 3 as opposed to the on position 90) initially the residual cold water in the hot water line will flow through the valve 80 to the recirculating line 68. As the temperature of the water flowing through the valve 80 begins to rise, the water will heat the valve stem 78. This heat will be passed by screw 76 to the metallic strip 72 causing the above described change in the color of the temperature sensing strip 66 from the initial black to red. The effective change occurs within seconds of the hot water passing through the recirculating/recycling valve 80 reaching a temperature of 100° F. The aforementioned color combinations may be altered as desired as long as the thermochromic leuco dye is darker than the underlying color. Also, by layering two thermochomic leuco dyes (as shown in FIG. 4A) on top of the non-changing color paint and by chemically calibrating the dyes to change at two different temperature ranges. For example, the top dye black color changes to translucent at 100° F. and transparent at 104° F. revealing phosphorescent blue dye 84 which changes to translucent at 108° F. and transparent at 112° F. revealing phosphorescent neon red, which is non-changing color paint. Thus, a three-color sequence can be achieved and the dyes chemically formulated to signal when water has reached warm, tepid and finally hot temperatures. Also, phosphorescence can be added to the dyes and the paint makes the colors glow in low light or darkness and facilitate seeing the temperature of the recycled water under low illumination conditions.

FIGS. 5 to 9 show the subject invention incorporated into a known "mixer ball" valve assembly 92 wherein the housing 94 is provided with a cold water port 96, a hot water port 98, a recycle port 100 and a faucet port 102. A hollow ball valve member 104 is movably mounted within the housing 94 and is controlled by handle 106 engaging a stem 108 fixed to and extending radially out from the hollow ball valve member 104. The mixer valve assembly 92 is completed with sealing means 110, positioning means 112, and hold down means 114 engaging the housing The hollow ball valve member 104 is shown in more detail in FIGS. 6, 6A and 6B. The member has four profiled openings, namely hot water 116, cold water 118, recycle 120 and faucet 122. The hollow ball valve member 104 fits within housing 94 and is held therein by the sealing means 110, positioning means 112, and hold down means 114. The stem 108 projects above the hold down means 114 and is engaged by the handle 106 to move the hollow ball valve member 104 to the several positions where the openings in the hollow ball align with the ports of the housing to control flow of water through the mixer assembly 92.

Figure 5:
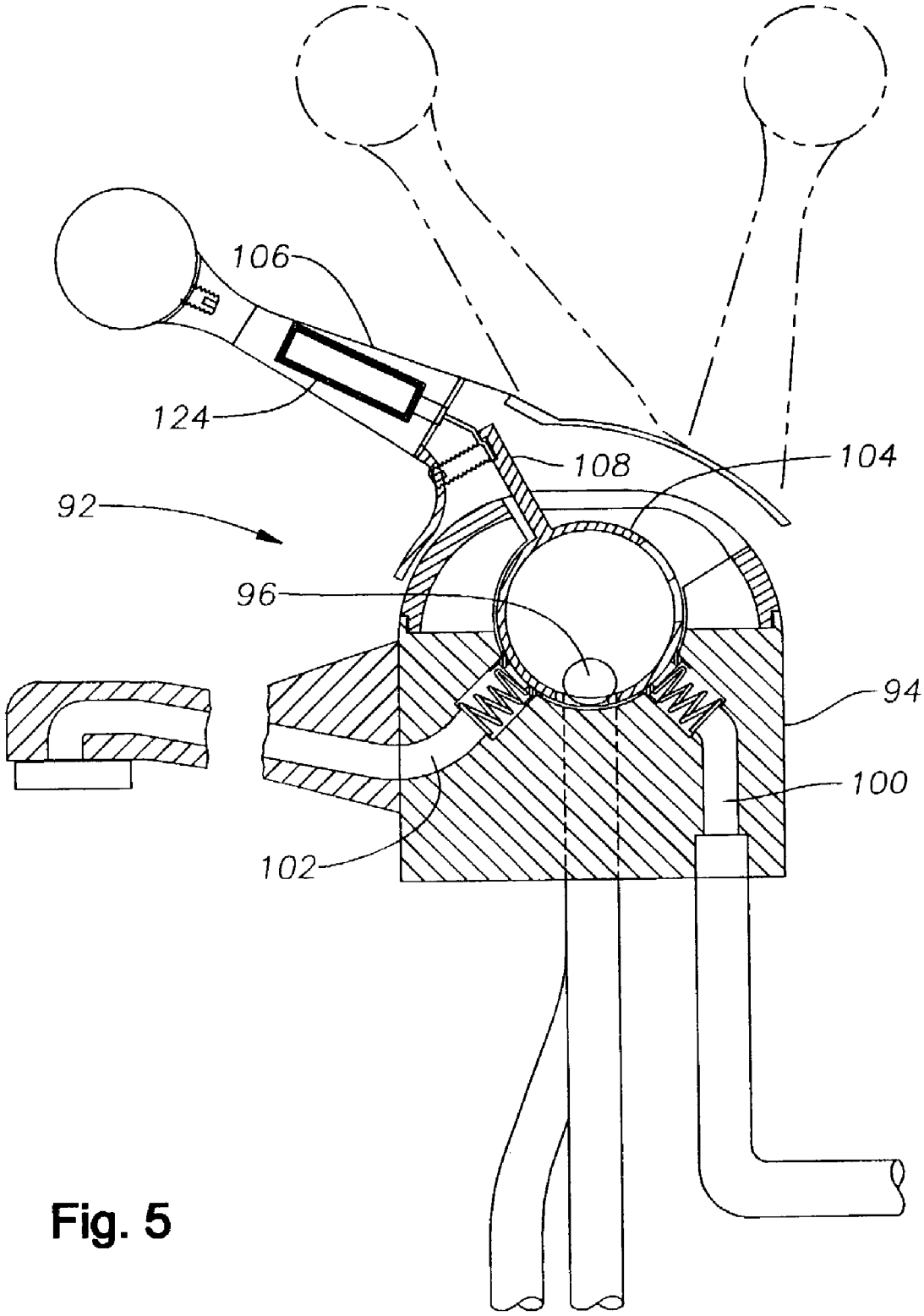
FIG. 5 is a vertical section thorough another type of faucet incorporating the present invention.
Figure 6A:
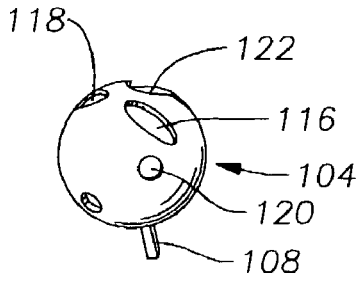
FIG. 6A is another view of the ball of FIG. 6 taken from a different angle than FIG. 6.
Figure 6B:
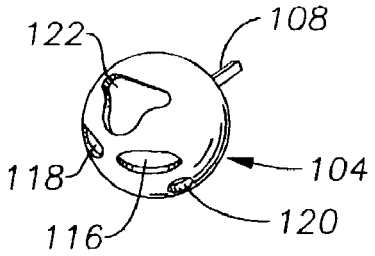
FIG. 6B is a further view of the bail of FIGS. 6 and 6A taken from yet another angle.
Figure 6:
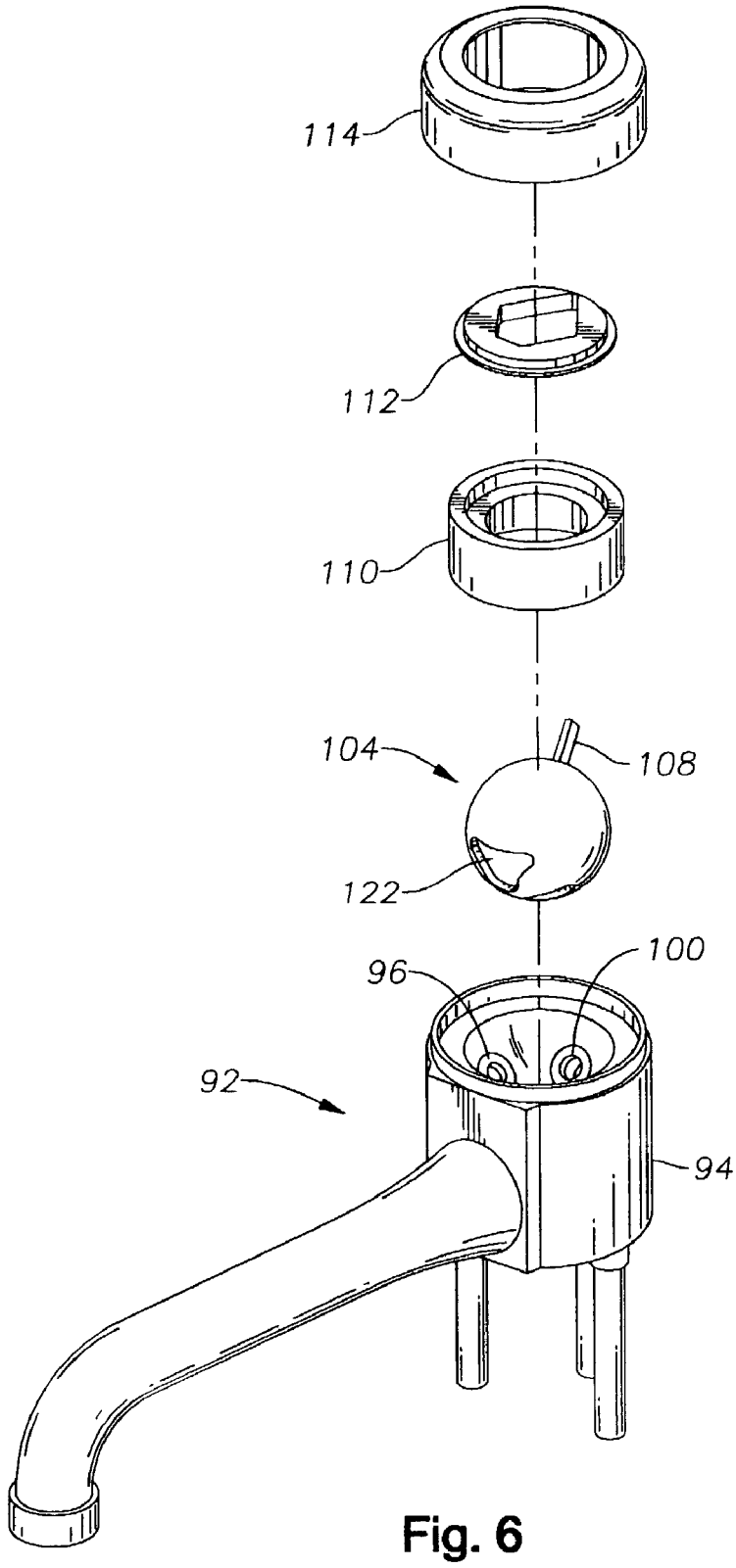
FIG. 6 is an exploded view of the faucet of FIG. 5.
Figure 7:
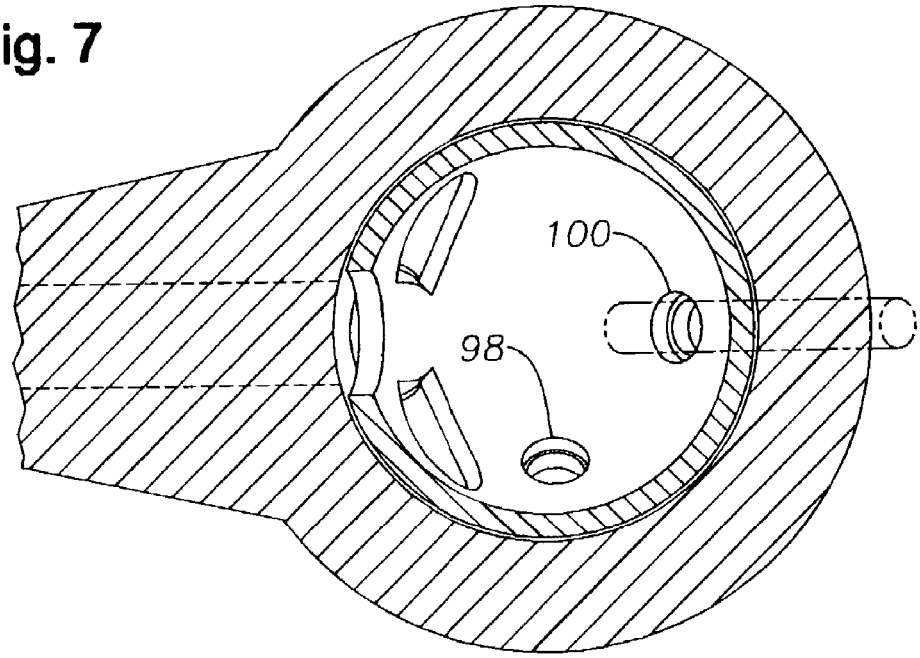
FIG. 7 is a transverse section taken along line 7—7 of FIG. 5 showing the subject valve in a recycling/recirculation condition.
Figure 8:
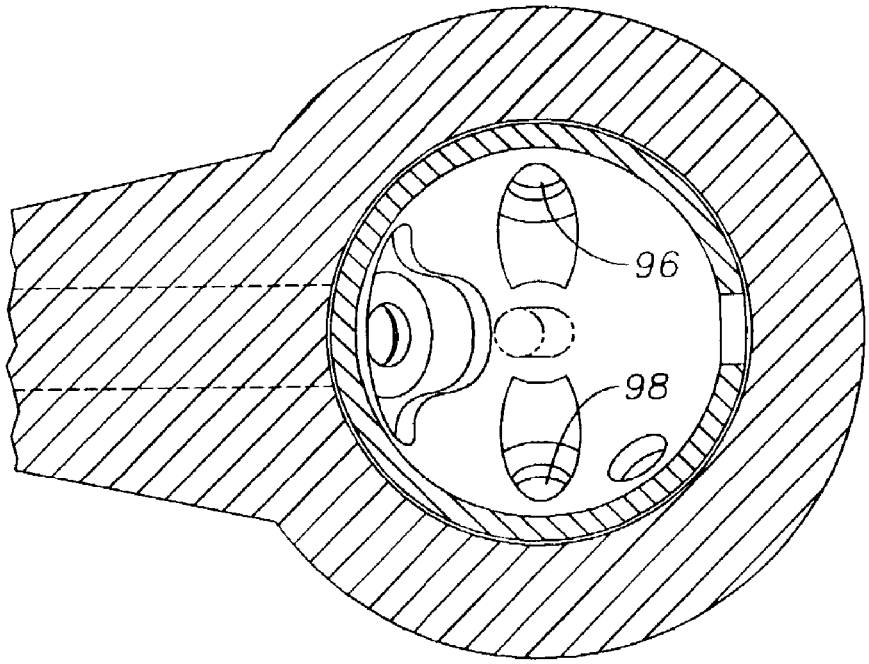
FIG. 8 is a view similar to FIG. 7 showing the subject valve in ad open mix position.
Figure 9:
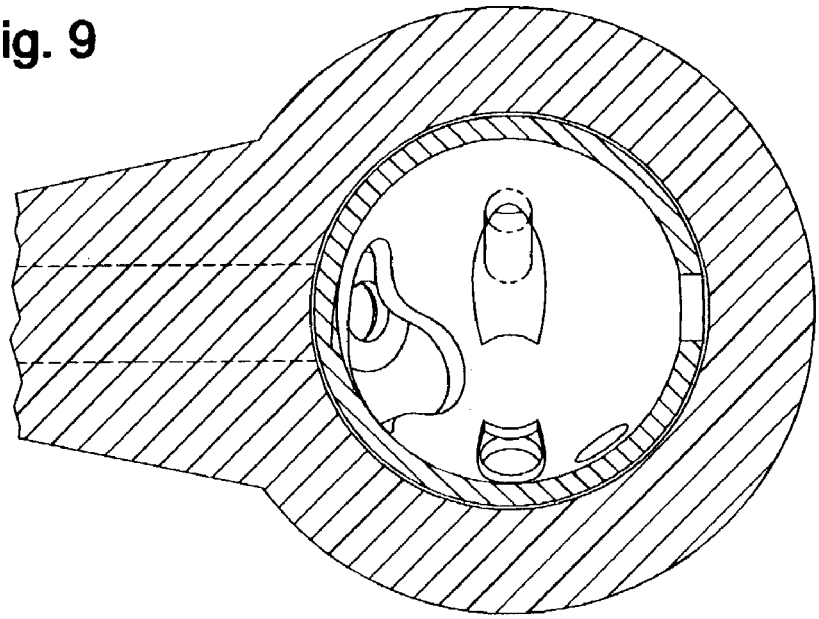
FIG. 9 is a view similar to FIGS. 7 and 8 showing the subject valve in an open hot water position.

When the handle 106 is moved to the full rearward position, shown in phantom in FIG. 5, the ball valve member 104 is positioned so that the residual cold water in the hot water line is diverted from the faucet port 102 to the recycle port 100. When the temperature indicator means 124 shows that the cold water has cleared from the hot water line and that water of warming temperature is now coming through the ball mixer valve system, the handle 106 is moved to a position so that water at the desired temperature will flow through the faucet 102.

Figure 11:
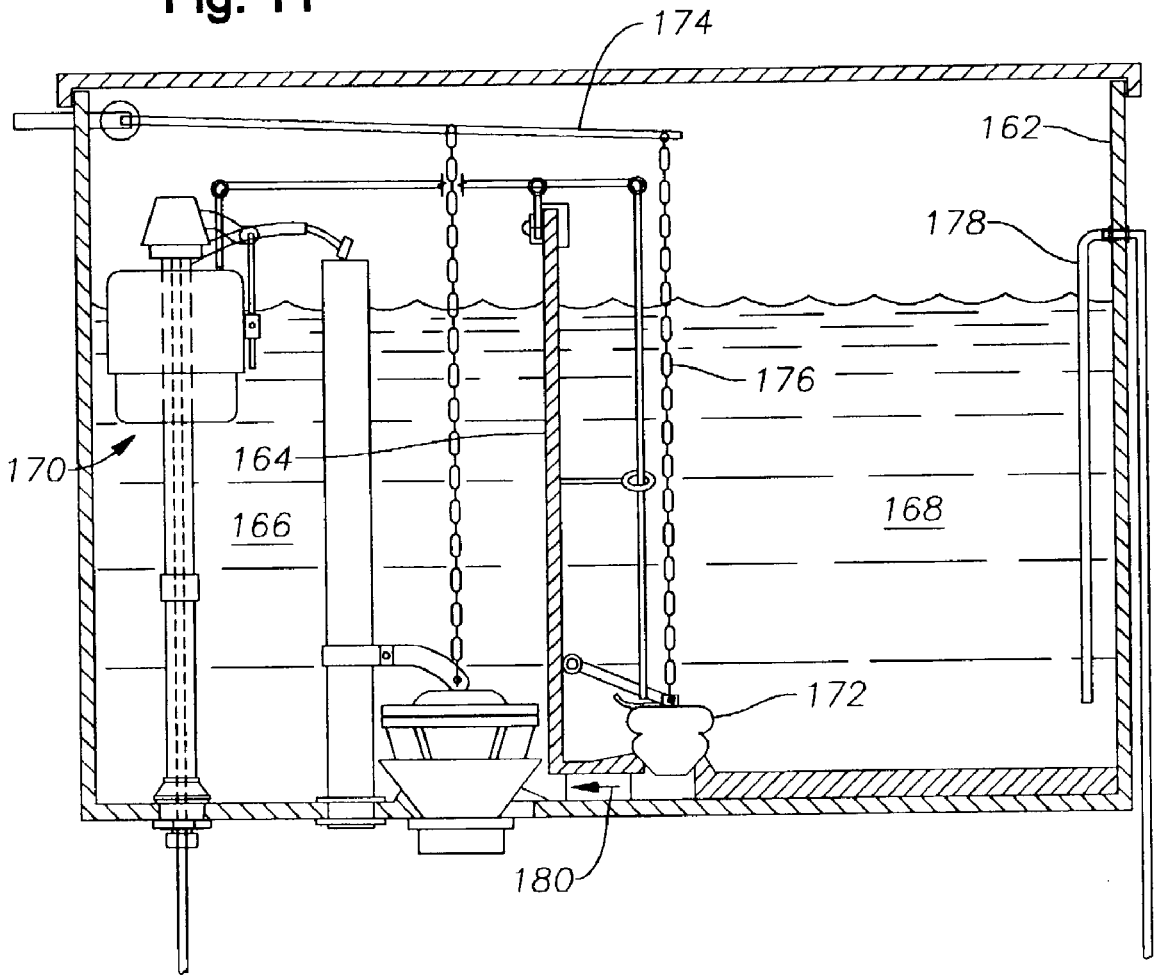
FIG. 11 is a vertical transverse section through a toilet tank in accordance with an alternative embodiment of the present invention.
Figure 10:
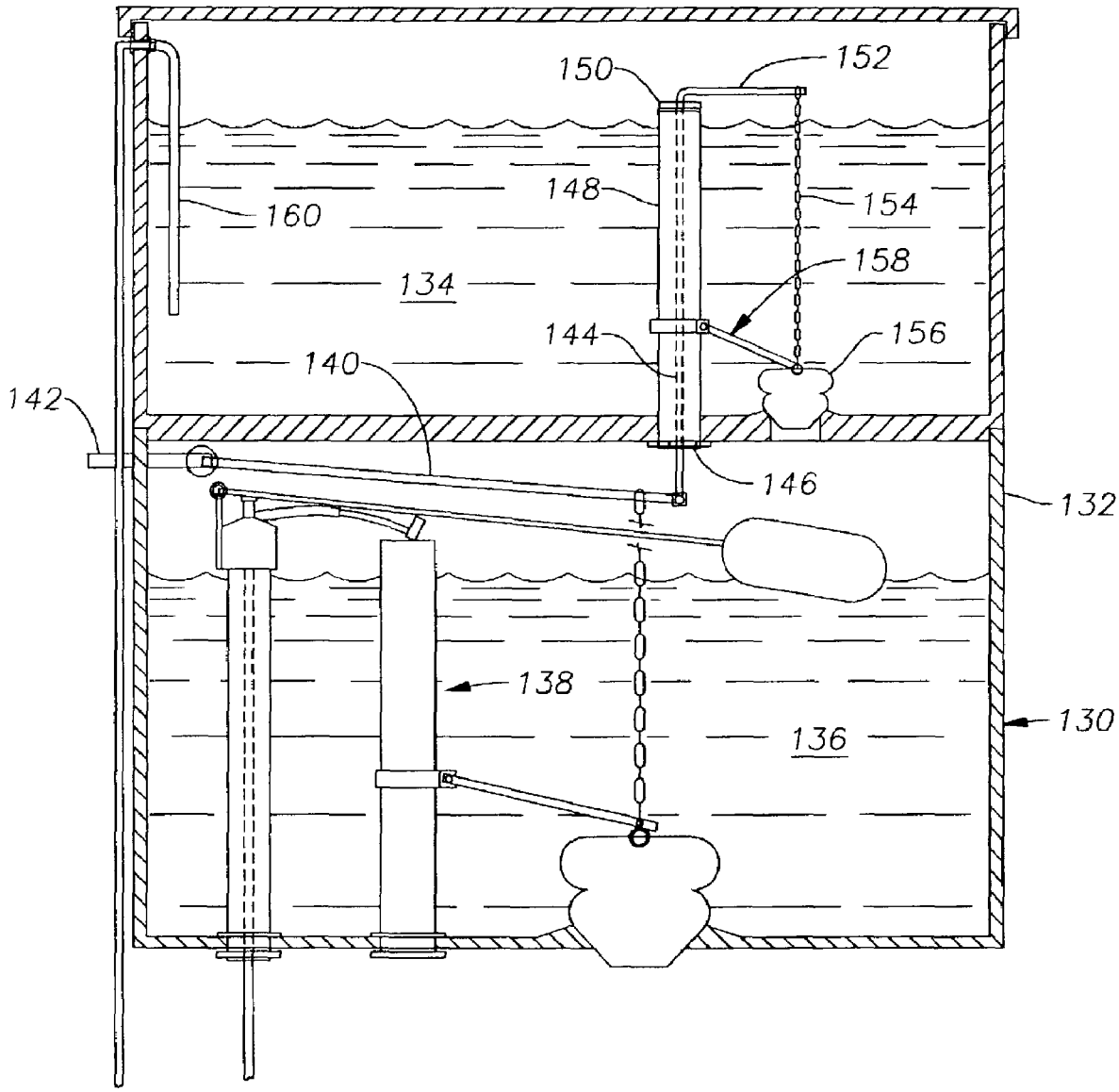
FIG. 10 is a vertical transverse section through a toilet tank in accordance with the subject invention.

Turning now to FIGS. 10 and 11, these figures show a modified toilet tank system which could be used in connection with either of the above discussed vale assemblies of the present invention. The toilet tank system 130, FIG. 10, has a tank with upper and lower compartments 134, 136, respectively. The lower compartment 136 contains a conventional toilet flush system 138 and need not be discussed in any detail. The free end of rod 140 connected to the flush handle 142 is connected to a rod 144 which extends vertically through seal 146 into the upper tank 134 where it passes axially through standpipe 148 and guide means 150. The upper end of rod 152 extends normal to the standpipe 148 and has a chain 154 attached to the free end thereof. The lower end of the chain 154 is attached to a floatation stopper 156 which is attached to the standpipe 148 by lever assembly 158. Recirculating/recycling return line 160 communicates with the upper tank 134.

In the normal operation of the previously described recirculating/recycling valves, the cold water from the hot water lines, which water was previously wasted, is sent to the upper tank 134. When the toilet is flushed, the rod 144 causes floatation stopper 156 to open to drain the recirculated/recycled water in the upper tank 134 to the lower tank 136 which will fill rapidly causing the float of the flush system 138 to close off water flow to the lower tank 136 after only a small amount of water has been allowed into the tank 136 from an outside source.

The alternate embodiment shown in FIG. 11 shows a toilet tank 162 having an internal vertical wall 164 dividing the tank into first and second chambers 166 and 168, respectively. Chamber 166 contains a conventional flush system 170. The second chamber contains a floatation stopper 172 connected to the rod 174 of the flush system 170 by chain 176. Chamber 168 also receives recirculation/recycle line 178 which come from the previously described valve system A check valve 180 is positioned between first and second chambers 166, 168.

When this embodiment is flushed, flotation stopper 172 is opened to flow recirculated/recycled water from chamber 168 to chamber 166 to fill the latter with the recirculated/recycled water and limit the flow of water from another source. Check valve 180 controls the one way flow of water from second chamber 168 to first chamber 166.

Effectively, this invention would allow water, which would otherwise be a lost resource, be used for flushing a toilet and will safely tell, even a child, when the water has reached a desired temperature—or too hot a temperature. By the effective color changes, it is possible to know when to open the valve to a normal open position to utilize the hot water, liquids or gases at a fairly precise temperature range. It should be noted that the sensing handle of the valve continues to operate in the same manner when the valve is turned to the normal "On" position. As hot water, liquids, or gases flow through the valve body, the temperature changes of such are shown. When the valve is in the recirculating/recycling position, the hot water, liquids or gases can be recirculated to any of the sources for the aforesaid hot water, liquids or gases that are at atmospheric pressure. The existing pressure of the system is utilized to return/recycle the resource. For instance, hot water can be returned to a well, cistern, storage tank, standpipe or toilet tank system. Other liquids or gases could be returned to any appropriate storage source at atmospheric pressure. When return to a standpipe is utilized, if the standpipe is tall enough, as in a standpipe on the upper level of a high rise building, then the standpipe can create enough pressure at the base of it to allow the recirculating recycling valves on the upper floors of the building via the standpipe to feed via a manifold connected to the base of the standpipe the toilets, sinks, tubs, showers, and other water needs of the lower floors, even directly feeding the pressurized main supply line.

When hot water is recirculated to the instant toilet tank system for recycling, the toilet tank system employed here allows acceptance of the recirculated hot water which otherwise would have been lost down the drain while waiting for the proper temperature to be attained. As shown in FIGS. 10 and 11 the tank may be an add-on-nested tank or a double tank in a single cavity. Both tanks accept a recirculating line from the recirculating/recycling valve(s) and are actuated when the toilet tank is flushed via turning the handle. The floating stopper of the recycling tank lifts simultaneously with the main tank floating stopper and whatever recycled water is in the recycle tank flows to the main tank to achieve the next flush. The drain of the recycling tank to the main tank is of one inch aperture while the drain from the main tank to the toilet is of two inches aperture. This arrangement allows the main tank to drain quickly enough to close the floating stopper as water flows out while the recycling tank continues to drain to the main tank. This aperture ratio may be adjusted for conditions and to achieve the desired amount of recycled water to assist with the flushing of the main tank. In this fashion this invention uses recirculated/recycled water to be utilized to flush a toilet. A safety precaution is also included in the recycling toilet system as there is an overflow devise in the way of a sandpipe in the add-on-nested tank which overflows surplus recycled water to the main toilet tank in the event of an over capacity of recycled water entering the tank. In the dual tanks in one cavity arrangement there is a separating baffle which acts as a weir dam over which can flow excess capacity water to the main tank. The main tank is fitted with a standard overflow standpipe to the toilet.

The present invention may be subject to many changes and modifications without departing from the spirit or essential characteristics thereof The present embodiment should therefor be considered in all respects as illustrative and not restrictive of the invention as defined by the appended claims.

I claim:

1. A method for conserving water by recirculating/recycling cold water present in hot water lines at the time hot water is called for, said method comprising the steps of:

providing a hot water valve assembly with a recirculation/recycle port and means for directing water from a hot water line attached to said valve assembly with said recirculation/recycle port;

providing container means to receive recirculated/recycled water;

opening said valve directly to a recirculation/recycling position until warm water arrives at said valve assembly; and moving said valve to a normal operating position allowing flow of hot water through the valve assembly.

2. A method for conserving water according to claim 1, wherein said valve assembly is a ball-type mixer valve.

3. A method for conserving water according to claim 1 wherein said valve assembly forms the hot water valve of a conventional two valve water system, the second valve controlling cold water flow.

4. A method for conserving water according to claim 1 further comprising:

providing water temperature indicating means, whereby the temperature of water passing through said valve assembly is sensed and the temperature thereof indicated visually.

5. A method for conserving water according to claim 1 wherein said temperature indicating means comprises:

a metallic member physically connected to a portion of said valve assembly which will be heated by water passing there through, a layer of non-changing color paint coating an exposed surface of said metallic member, and a thermochromic leuco dye coating said paint, whereby, as said metallic member heats up, the thermochromic leuco dye changes in transparency to reveal the underlying color paint giving warning of the change in water temperature.

6. A method for conserving water according to claim 1 wherein said container means comprises:

a toilet tank having a primary compartment with convention flushing apparatus therein and a secondary compartment receiving water from said valve assembly, and drain valve means between said primary and secondary compartments, whereby when said flushing apparatus is actuated said drain valve is opened allowing water from said secondary compartment to flow into said primary compartment.

7. A fluid conservation system which recirculates and/or recycle fluids not at a desired temperature and which heretofore have been lost down drains during the time it takes for a desired temperature of the fluid to be attained, said system comprising:

a valve assembly having a housing with a hot water intake port, a hot water dispensing port and a recirculation/recycling port, valve means movably mounted in said housing, handle means mounted on said housing and attached to said valve means for moving said valve means selectively between off, normal and recirculating/recycling positions; and container means attached to and receiving fluid from said recirculating/recycling port, whereby the fluid thus received can be utilized rather than wasted simply because it was below temperature.

8. The system according to claim 1 wherein said valve assembly is a ball-type mixer valve housing and further has a cold water port.

9. The system according to claim 7 wherein said valve assembly forms the hot water valve of a conventional two valve water system, the other valve controlling cold water flow.

10. The system according to claim 7 further comprising:

water temperature indicating means, whereby the temperature of water passing through said valve assembly is sensed and the temperature thereof indicated visually.

11. The system according to claim 4 wherein said temperature indicating means comprises:

a metallic member physically connected to a portion of said valve assembly which will be heated by water passing there through, a layer of non-changing color paint coating an exposed surface of said metallic member, and a thermochromic leuco dye coating said paint whereby, as said metallic member heats up, the thermochromic leuco dye changes in transparency to reveal the underlying color paint giving warning of the change in water temperature.

12. The system according to claim 7 wherein said container means comprises:

a toilet tank having a primary compartment with convention flushing apparatus therein and a secondary compartment receiving water from said valve assembly, and drain valve means between said primary and secondary compartments, whereby when said flushing apparatus is actuated said drain valve is opened allowing water from said secondary compartment to flow into said primary compartment.

* * * * *